United States Patent [19]

Kimm et al.

[11] 4,174,044

[45] Nov. 13, 1979

[54] ORIGINAL CLOSURE MEMBER

[75] Inventors: Otfried Kimm; Theo Hammes; Peter Loebler, all of Cologne, Fed. Rep. of Germany

[73] Assignee: Mauser Kommandit-Gesellschaft, Brühl, Fed. Rep. of Germany

[21] Appl. No.: 946,969

[22] Filed: Sep. 29, 1978

[30] Foreign Application Priority Data

Oct. 5, 1977 [DE] Fed. Rep. of Germany ..... 2744787

[51] Int. Cl.[2] ..... B65D 41/34

[52] U.S. Cl. ..... 215/252

[58] Field of Search ..... 215/252; 220/266, 268

[56] References Cited

U.S. PATENT DOCUMENTS 3,310,191 3/1967 Kern ..... 215/252

4,081,097 3/1978 Dold ..... 215/252

*Primary Examiner*—Donald F. Norton

*Attorney, Agent, or Firm*—Toren, McGeady and Stanger

[57] ABSTRACT

An original closure member for the pouring spout of a container includes a screw cap and a separate safety ring. The safety ring includes a break-off section connected at one end to the remainder of the safety ring but being separate from the ring at its opposite end. A stop cam projects inwardly from the break-off section into the path of lugs extending downwardly from the lower end of the screw cap. The stop cam yields when the cap is screwed onto the pouring spout, however, when the cap is unscrewed, the stop cam is unyielding and, as a result, the break-off section separates from the rest of the safety ring.

4 Claims, 3 Drawing Figures

ORIGINAL CLOSURE MEMBER

SUMMARY OF THE INVENTION

The present invention is directed to an original closure member for the pouring spout of a container and, more particularly, it is directed to a closure member consisting of a screw cap and a separate safety ring.

Original closure members for containers are known where the closure member consists of a screw cap and a safety ring formed of a plastics material with the safety ring being destructible the first time that the cap is unscrewed. Further, it has been known to provide the screw cap and safety ring as separate parts.

Unlike closure members where the screw cap safety rings are formed as a unit, where a separate screw cap and safety ring are used, the finished container can be closed with the screw cap and shipped to a filling plant so that no dirt can enter the container during transport. The safety ring is provided as a separate element. To fill the container, the screw cap is removed from the pouring spout, the safety ring is placed on the pouring spout and the cap is replaced after the filling operation is completed.

It is the purpose of the safety ring to afford easy recognition of any unauthorized opening of the screw cap and removal of the container contents. Accordingly, uniformly distributed predetermined breaking points are provided about the circumference of the safety ring which are broken when the screw cap is removed. It is possible, however, for several predetermined breaking points to separate simultaneously and to result in the creation of such play that the safety ring can widen without the individual ring parts actually falling off. The parts of the safety ring remain connected so that the adhering ring parts can once again be pressed together after closing the container. Accordingly, it is generally impossible to recognize that the container has been opened.

To overcome this problem, an original closure member for containers was developed consisting of a screw cap and a safety ring which is destructible during the cap unscrewing operation and the ring is provided with a break-off section connected to the remainder of the ring by predetermined separation points. Further, a stop cam is provided on the side surface of the break-off section and the cam is unyieldable in the unscrewing direction, but is yieldable in the direction in which the cap is screwed on to the container. The stop cam is contacted by a lug or pin projecting axially downwardly from the lower edge of the screw cap and the safety ring is rigidly held on the container.

Since only one break-off section is provided connected to the remaining portion of the safety ring, the force for separating the break-off section is concentrated at the two predetermined separating points. It is not possible for the ring to yield otherwise. Since the opening or fracture of the predetermined separating points takes place successively, the break-off section is separated from the ring and thrown off as a whole. Subsequently, it is not possible to join the individual parts of the safety rings together.

This construction, however, has the disadvantage of being stiff or rigid because of the manner in which the break-off section is joined to the remainder of the safety ring. Because of its stiff or unyielding character, the safety ring cannot adapt to variations in the tolerance of the neck or sleeve at the pouring spout of the container and, accordingly, the break-off section may be accidentally separated when the cap is screwed onto the spout. As a result, the intended effect would be lost. Moreover, the stiffness of such safety rings poses problems for the transport of the rings shipped separately from the containers, since they are unable to absorb impact stresses elastically and they break open.

Therefore, it is the primary object of the present invention to improve the safety rings having a single break-off section so that the problems experienced in the past are overcome.

In accordance with the present invention, the break-off section is connected at one end via a predetermined separating point or web to the safety ring while its other end is separate from the ring and forms a gap with the adjacent end of the ring. The ends of the remaining ring section adjacent the break-off section are interconnected by a bridging strap located inwardly of the break-off section and the strap is shaped to conform to the contour of an adjacent abutment on the container. Further, the bridging strap is positioned so that it does not contact the lugs formed on the lower end of the screw cap. Moreover, a connecting web extends between the break-off section intermediate its ends and the outwardly facing surface of the bridging strap. Additionally, the inwardly facing surface of the remaining section of the ring opposite the bridging strap is also shaped to conform to the adjacent abutment on the container.

Due to the comparatively rigid connection of the break-off section to the remaining section of the safety ring where only one predetermined separating point is employed, the separating point acts, in a limited manner, as a joint and, due to the opening at the other end of the break-off section, a high degree of resilience is achieved. Such resilience is limited, however, because of the coupling effect afforded by the connecting web between the bridging strap and the break-off section so that an adjustment of the ring to any differences in the tolerances of the pouring spout is possible, and a yielding of the break-off section is safely prevented when the lugs, extending downwardly from the lower end of the screw cap, act against the stop cam when the cap is screwed onto the pouring spout.

When the cap is screwed onto the container, the open gap between the break-off section and the remainder of the ring is closed and the break-off section is supported, however, since the connecting web joins the bridging strap and break-off section together, the break-off section cannot move radially outwardly. Only when the cap is subsequently unscrewed from the pouring spout will the predetermined separating point and the connecting web break causing the break-off section to be displaced outwardly.

Since the bridging strap can yield when the safety ring is not mounted on the container, the forces acting on the ring during shipment can be absorbed elastically and any breaks in the ring are prevented. When the ring is placed on the abutment formed on the container, the yieldable feature of the bridging strap is cancelled out so that the breaking or separating feature at the predetermined separation point and the connecting web becomes effective.

When the original closure is secured to a filled container, the break-off section is protected against any accidental outside influences based on another feature of the invention involving the formation of the container abutment in the form of a hexagonally-shaped projection located in the depression or recess surrounding the base of the pouring spout on the container. When the safety ring is positioned on the container, it engages the abutment in a form-locking manner along the bridging strap and along a portion of the remainder of the ring opposite the bridging strap. The side walls of the hexagonally-shaped projecting abutment contacted by the safety ring are longer than the other walls of the abutment. Accordingly, the break-off section extends generally in the same direction as the longer hexagonal walls which are in form fitting engagement with the surfaces of the bridging strap and the remaining section of the safety ring.

The configuration of the projecting abutment has the inevitable effect that the safety ring, when placed onto the pouring spout, will always be located between protective side walls of the depression or recess, which depression is open to the exterior of the container.

Still another feature of the invention is the provision of a collar or flange extending radially outwardly from the lower end of the screw cap so that the collar rests against the upper edge of the safety ring when the cap is fully screwed onto the pouring spout. Because of this construction, it is not possible to disengage the stop cam by inserting a tool into the safety ring.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
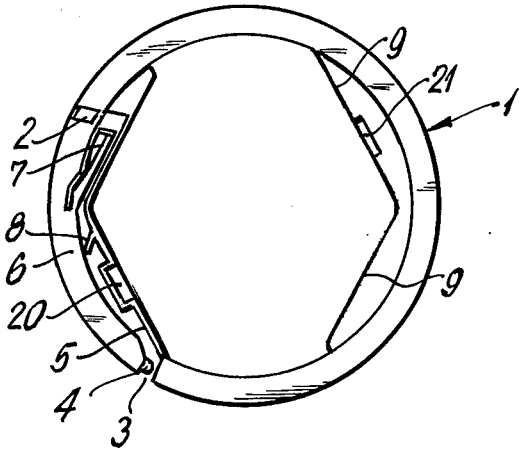
FIG. 1 is a top view of the safety ring embodying the present invention.

In the drawing, the original closure member is formed by a safety ring 1 and a separate screw cap 15. The safety ring 1 includes a break-off section 6 extending for a part of the circumferential dimension of the ring. Formed on the inwardly facing surface of the break-off section 6 is a stop cam 7 which is shaped so that it yields against the break-off section when the cap 15 is screwed onto the container but is unyieldable when the cap is unscrewed. When the safety ring is placed about the threaded pouring spout 10 of the container and the cap 15 is screwed onto the spout to effect its closure, one of the axially downwardly extending lugs 16, note FIG. 2, on the lower end of the screw cap is juxtaposed to or abuts against the surface of the stop cam extending transversely across the path of movement of the lugs as the cap is screwed on the pouring spout. One end of the break-off section is joined to the adjacent end of the remaining section of the safety ring by a web 2 forming a predetermined separating point while the opposite end of the break-off section is spaced from the adjacent end of the remaining section forming an open gap 3 therebetween. A spherically shaped protuberance or abutment 4 is provided on the end of the break-off section forming one side of the gap 3 and the protuberance extends into contact with the adjacent end of the remaining section of the ring.

Figure 2:
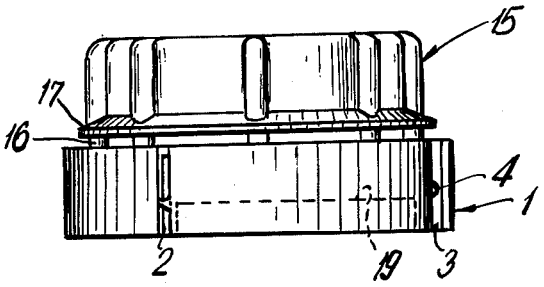
FIG. 2 is a side view of the safety ring and screw cap axially separated from one another.

The ends of the remaining section of the safety ring at the opposite ends of the break-off section 6 are interconnected via a bridging strap 5 located inwardly of the inwardly facing surface of the break-off section. In FIG. 2, dotted line 19 illustrates the upper edge of the bridging strap and this upper edge is located below the lower ends of the lugs 16 when the cap is fully screwed onto the pouring spout and, thus, the upper edge of the bridging strap does not interfere with the screw cap 15 forming a closure for the container.

Approximately equidistantly between the ends of the break-off section 6 is a connecting web 8 formed integrally with the bridging strap and the break-off section interconnecting the two parts.

Figure 3:
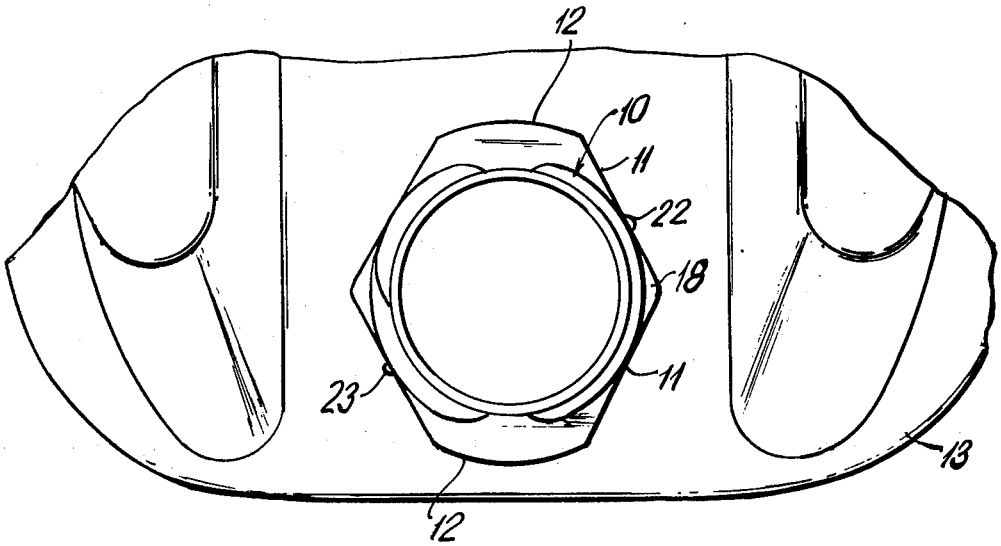
FIG. 3 is a partial top view of the container adapted to receive the safety ring and screw cap.

At the base of the threaded pouring spout 10 where it is joined to the container 13, note FIG. 3, a recess or depression is formed in the surface of the container and the depression is open toward the adjacent side of the container. For securing the safety ring 1 on the container about the pouring spout, an upwardly projecting hexagonally-shaped abutment is formed from the bottom of the depression. As viewed in FIG. 3, the side walls 11 of the hexagonally-shaped abutment are longer than the two side walls 12 which extend generally transversely of the side walls 11.

As can be appreciated by comparing FIGS. 1 and 3, the inwardly facing surfaces of the bridging strap 5 and the oppositely located stop surfaces 9 on the remaining section of the safety ring are shaped in a complementary manner to the side walls 11 of the hexagonally-shaped abutment. When the safety ring is placed on the pouring spout 10, the complementary shaped surfaces on the bridging strap 5 and the stop surfaces 9 fit against the side walls 11 so that the otherwise yieldable bridging strap is stiffened and the safety ring 1 is rigidly secured about the pouring spout on the container.

As illustrated in FIG. 2, the lower end of the outer wall screw cap 15 has a radially outwardly projecting flange or collar 17 which abuts against the upper edge of the safety ring when the cap is fully screwed onto the pouring spout.

To ensure that the safety ring is held in its fixed position on the hexagonally-shaped abutment 18 as the cap 15 is unscrewed so that the ring cannot be lifted separately, in accordance with the invention, the inwardly facing surface of the bridging strap 5 between the connecting web 8 and the gap 3 is provided with a pocket-shaped portion 20 closed at the bottom. At the diagonally opposite inwardly facing surface of the stop surface 9, another similarly shaped pocket 21 is provided, the bottom of which is also closed.

In FIG. 3, a pair of protuberances 22, 23 extend outwardly from diagonally opposite side walls 11 of the abutment 18 so that the pockets 20, 21 fit over the protuberances and their closed bottoms prevent the safety ring from being lifted upwardly over the protuberances.

While specific embodiments of the invention have been shown and described in detail to illustrate the application of the inventive principles, it will be understood that the invention may be embodied otherwise without departing from such principles.

What is claimed is:

1. An original closure member for a container comprising a screw cap having an axis about which it is screwed onto and unscrewed from the container and a safety ring which is destructible when said screw cap is unscrewed from the container, said safety ring including a break-off section having a predetermined point of separation, said safety ring including said break-off section having an inwardly facing surface, a stop cam formed on said extending inwardly from the inwardly facing surface of said break-off section, said stop cam being yieldable in the screwing-on direction of said cap and being unyieldable in the unscrewing direction of said cap, said cap having a plurality of lugs projecting downwardly from the lower end thereof in the axial direction of the cap, said safety ring being held rigidly in position on the container and one of said lugs being located adjacent to said stop cam for contact therewith when said screw cap is removed from the container, wherein said safety ring comprises a circumferentially extending section having a first end and a second end spaced angularly from said first end, said break-off section extending in the circumferential direction of said safety ring between the first and second ends of said circumferentially extending section thereof and having a first end and a second end spaced angularly apart, a break-off web interconnecting the first end of said circumferentially extending section and the first end of said break-off section, and a separation gap formed between the second end of said break-off section and the second end of said circumferentially extending section, a bridging strap located inwardly of said break-off section within said safety ring and connected at one end thereof to said circumferentially extending section adjacent the first end thereof and at the other end thereof to said circumferentially extending section adjacent the second end thereof so that said strap bridges the circumferentially extending portion of said safety ring formed by said break-off section, said bridging strap having an inwardly facing surface shaped to conform to the configuration of the container where the closure member is attached, said bridging strap having an upper edge spaced below the lower end of said cap when said cap is fully screwed onto the container so that said lugs on the lower end of said cap do not contact the upper edge of said bridging strap when said strap is screwed onto the container, a connecting web secured at one end to the inwardly facing surface of said break-off section intermediate the first and second ends thereof and at the other end to the outwardly facing surface of said bridging strap intermediate the ends thereof, and the inwardly facing surface of said circumferentially extending section of said safety ring located opposite said break-off section is shaped to conform to the configuration of the container where the closure member is attached.

2. An original closure member, as set forth in claim 1, including a pouring spout having a threaded outer surface for receiving said screw cap, a recessed wall portion forming the connection of said pouring spout to the container, said recessed wall portion forming a depression extending around the base of said pouring spout, a hexagonally shaped abutment formed in and projecting upwardly from said depression in the axial direction of said pouring spout, said hexagonally-shaped abutment arranged to fit in form-locking engagement with said safety ring between the inwardly facing surface of said bridging strap and the inwardly facing surface on the circumferentially extending section of said safety ring opposite said bridging strap, only certain of the hexagonal sides of said abutment being in contact with said bridging strap and the circumferentially extending section of said safety ring, the hexagonal sides of said abutment in contact with said bridging strap and the circumferentially extending section of said safety ring opposite said bridging strap being longer than the other hexagonal sides, and said break-off section extending in the same general direction as the longer hexagonal sides of said abutment.

3. An original closure member, as set forth in claim 2, wherein said bridging strap between said connecting web and the second end of said break-off section has a first outwardly projecting pocket with the lower end of said first pocket being closed, the surface of the circumferentially extending section of said ring located diagonally opposite said first pocket having a second outwardly projecting pocket of similar configuration with the lower end thereof being closed, an outwardly extending protuberance formed on each of a pair of diagonally opposite said longer hexagonal sides of said abutment so that said protuberances each engage in a different one of said first and second pockets with said protuberances bearing against the closed lower end of each said pocket for preventing axially upward movement of said safety ring.

4. An original closure member, as set forth in claim 1, wherein said cap has a radially outwardly projecting collar at the lower end thereof with said lugs projecting downwardly from said collar, and said collar contacting the upper edge of said safety ring when said cap is fully screwed onto the container.

* * * * *